US005664764A

United States Patent [19]

Ruppricht

[11] Patent Number: 5,664,764

[45] Date of Patent: Sep. 9, 1997

[54] DEVICE FOR STRETCHING CARPETS WITH A HOLD DOWN

[75] Inventor: Udo Ruppricht, Ahaus-Wessum, Germany

[73] Assignee: Wolff GmbH, Bietigheim/Bissingen, Germany

[21] Appl. No.: 515,739

[22] Filed: Aug. 16, 1995

[30] Foreign Application Priority Data

Nov. 2, 1994 [DE] Germany ..... 44 39 034.3

[51] Int. Cl.[6] ..... B25B 25/00; B65H 77/00

[52] U.S. Cl. ..... 254/209; 294/8.6

[58] Field of Search ..... 254/209, 210, 254/211, 212; 294/8.6

[56] References Cited

U.S. PATENT DOCUMENTS

| | | | |
|---|---|---|---|
| 733,716 | 7/1903 | Hall | 254/209 |
| 910,595 | 1/1909 | Smith | 254/209 |
| 3,963,216 | 6/1976 | Victor | 254/209 |
| 3,980,274 | 9/1976 | Ebert | 254/212 |
| 5,150,884 | 9/1992 | Hyer et al. | 254/209 |
| 5,183,238 | 2/1993 | Sorensen | 254/209 |

FOREIGN PATENT DOCUMENTS 35 30 423 A1 2/1986 Germany .

*Primary Examiner*—Daniel P. Stodola
*Assistant Examiner*—Emmanuel M. Marcelo
*Attorney, Agent, or Firm*—Griffin, Butler, Whisenhunt & Kurtossy

[57] ABSTRACT

A device for stretching carpets (11) to be laid on a plane floor (12) with nail ledges (14) in a vicinity of walls, without adhesives being used, includes a stretching head (22) which has spikes (25) and which is movable via a lever drive mechanism (20, 21) arranged on a base unit (17). A tensioning ledge (28), which engages behind the nail ledge (14), and a hold-down element (31), which acts in an area of the surface of the nail ledge (14), are mounted for pivotal movement. The tensioning ledge (28) and the hold-down element (31) are each respectively mounted on a first and a second bracket member (27 and 30), and the two bracket members are arranged for pivotal movement about a joint fulcrum (19) on the base unit.

11 Claims, 2 Drawing Sheets

DEVICE FOR STRETCHING CARPETS WITH A HOLD DOWN

BACKGROUND OF THE INVENTION

This invention relates to a device for stretching carpets to be laid on a plane floor with nail ledges mounted in a vicinity of walls, without adhesives being used; the device including a stretching head having spikes and being movable via a lever drive mechanism arranged on a base unit.

As awareness of ecological problems continuously grow, use of adhesives for installing carpets is becoming more problematic because such adhesives contain aggressive solvents. Disposal of worn, ripped out carpets, which have adhesive layers glued thereto, is also becoming more expensive and difficult because burning processes for incinerating these carpets are getting more complicated and costly in light of legal regulations.

In order to overcome these shortcomings, the process of stretching carpets, without resorting to adhesive, is used more and more.

In German Offenlegungsschrift 35 30 423, a carpet stretcher is described which comprises a gripping head with a number of spikes projecting downwardly and forwardly from its bottom surface. A knee pad is attached at an opposite end of the gripping head via a substantially air-tight cylinder. When a carpet is to be stretched, the user pushes the knee pad with his knee. The air cylinder serves for shock absorption and transmits the force, applied by the knee, from the knee pad to the gripping head.

This known device is disadvantageous in that a force produced for stretching the carpet depends on the physical strength of the user's knee, which might, in the long run, affect the user's health.

It is therefore an object of this invention to provide a device of the type mentioned in the opening paragraph above which has a simple and compact construction, can be easily handled and reliably operated but yet which does not overly depend on physical strength of a user and does not affect the user's health.

SUMMARY OF THE INVENTION

According to principles of this invention, a tensioning ledge, for engaging behind a nail ledge, and a hold-down element, acting in an area of a surface of the nail ledge, are mounted on a base unit of a stretching device of this invention for pivotable movement in a vertical direction. The tensioning ledge is arranged to be lifted when the hold-down element rests on the nail ledge.

BRIEF DESCRIPTION OF THE DRAWING

The invention is described and explained in more detail below using the embodiments shown in the drawings. The described and drawn features, in other embodiments of the invention, can be used individually or in preferred combinations. The foregoing and other objects, features and advantages of the invention will be apparent from the following more particular description of a preferred embodiment of the invention, as illustrated in the accompanying drawings in which reference characters refer to the same parts throughout the different views. The drawings are not necessarily to scale, emphasis instead being placed upon illustrating principles of the invention in a clear manner.

DESCRIPTION OF THE PREFERRED EMBODIMENT

Figure 1:
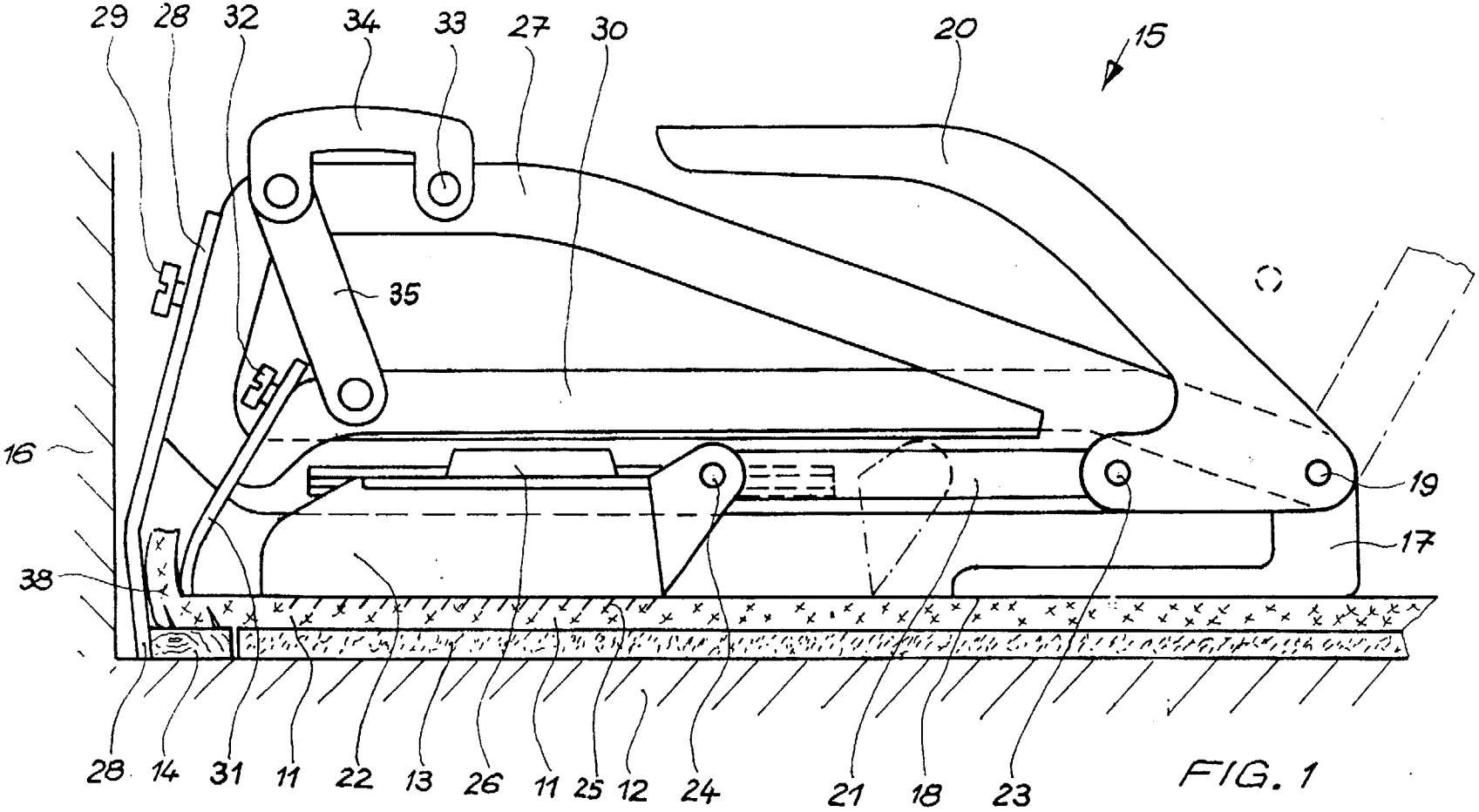
FIG. 1 is a side elevational view of a device according to this invention.
Figure 2:
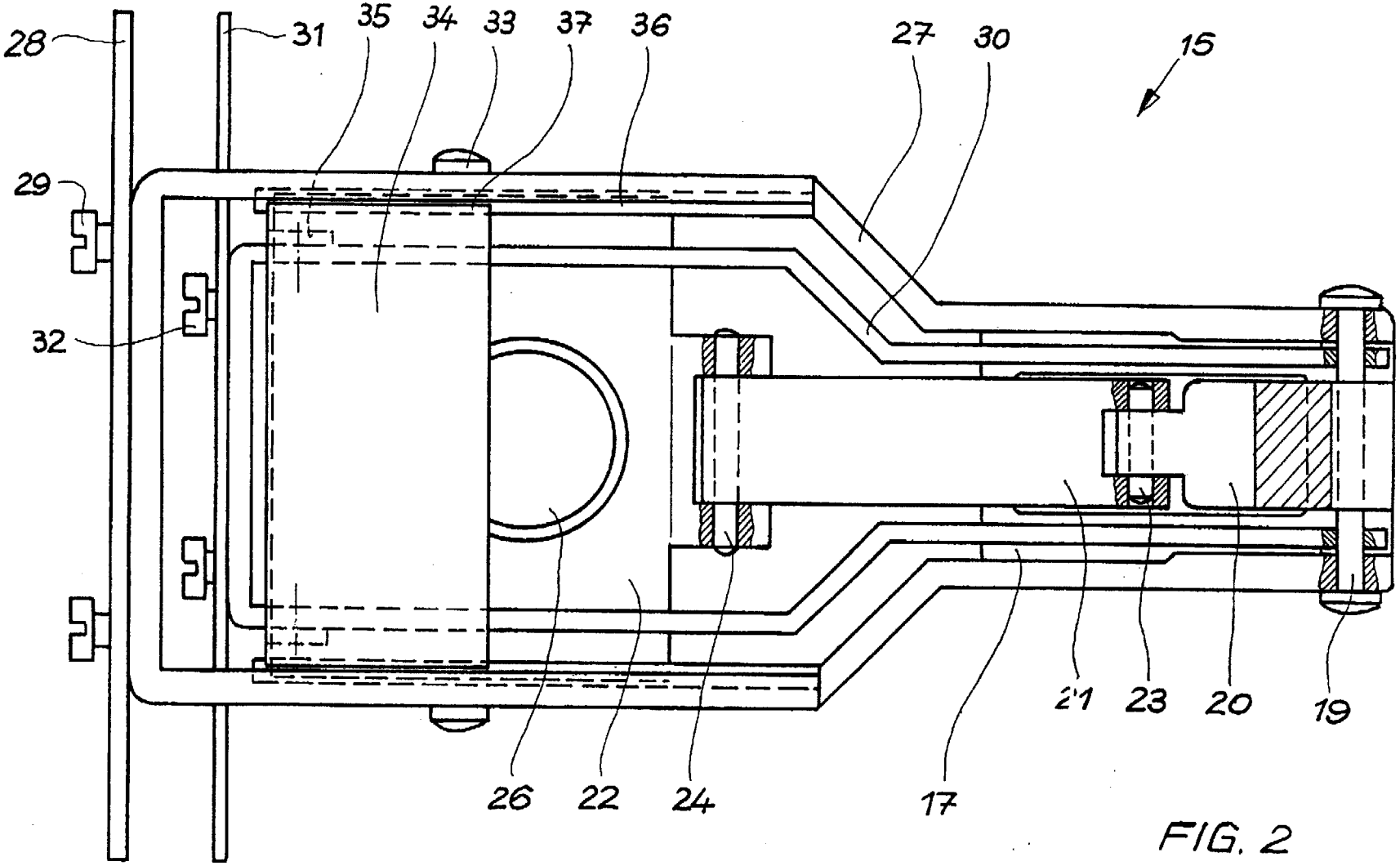
FIG. 2 is a top plan, partially cutaway, view of the device of FIG. 1.

A stretching device 15, illustrated in the drawings, is for installing a carpet 11 on a floor 12 on which a felt underlay, or padding, 13 is placed and on which a nail ledge 14 is attached a small distance from a wall 16.

The stretching device 15 includes a base unit 17 having a first support surface 18 for resting on the carpet 11. A lever 20, which is pivotally linked with a stretching head 22 via a coupling rod 21, is mounted on the base unit 17 for pivotal movement about a fulcrum 19. For this purpose, the coupling rod 21 is pivotally mounted at a pin 23 of lever 20 and at a journal 24 of the stretching head 22. The stretching head 22 is provided on its bottom side with spikes 25 which penetrate the carpet. The depth to which these spikes penetrate can be regulated by an adjustment button 26.

A first bracket member 27 is also pivotally mounted at the fulcrum 19, the first bracket member extending beyond the stretching head 22 and being provided at its end facing the wall 16 with a tensioning ledge 28. The ledge 28 is adjustable on the first bracket member 27 relative to the stretching head 22, both in a vertical and in a transverse direction, and can be fixed by screws 29. When the stretching device 15 is in an operative mode, the tensioning ledge 28 rests on the floor 12 and engages behind the nail ledge 14.

A second bracket member 30 is also pivotally mounted at the fulcrum 19, this member extending beyond the stretching head 22 and being provided at its end facing the wall 16 with a hold-down element 31. The hold-down element 31 is adjustable on the second bracket member relative to the stretching head 22 both in the vertical and in the transverse direction and can be fixed by screws 32. When the stretching device 15 is in an operative mode, the hold-down element 31 rests on the carpet 11 in an area between rows of nails of the nail ledge 14.

An arch 34 is pivotally mounted at an axle 33 on the bracket member 27, the arch being hingedly connected with the second bracket member 30 via a link 35. The bracket members 27 and 30 are thus movable relative to each other.

On the bracket member 27, guide elements, or tracks 36, which are opposite each other, extend parallel with the floor and are engaged by guide ledges 37 of the stretching head 22.

In the depicted embodiment, the tensioning ledge 28 and the hold-down element 31 are about twice as wide as the stretching head 22. Due to the fact that the stretching head 22, the tensioning ledge 28 and the hold-down element 31 are close to one another, the carpet is prevented from forming folds and waves when it is being laid.

For carrying out a stretching operation, the base unit 17 and the stretching head 22 of the stretching device 15 are placed on the floor 11, and a free end 38 of carpet 11 is pulled upwards between the tensioning ledge 28 and the hold-down element 31. For this purpose, the bracket member 30 is lifted together with the hold-down element 31 by means of the arch 34. Then the screws 29 are loosened and the tensioning ledge 28 is vertically shifted until it rests on the floor 12 and fully engages behind the nail ledge 14. The screws are now tightened again. This helps to even out various heights of carpets 11.

The hold-down element 31 is adjusted in the same way so that its blade facing the carpet 11 is positioned between the rows of nails of ledge 14.

The stretching head 22 is now retracted via lever 20. During this operation, the stretching head 22 and the pin 23 move to the positions shown in dashed lines before being urged towards the wall 16 with a vertical load fully acting on the stretching device 15 so that the carpet 11, held at its opposite end edge by another nail ledge, is stretched.

Pressure on the arch 34 causes the hold-down element 31 to be urged towards the floor. Thus, the carpet 11 is pressed into the rows of nails of ledge 14 and held stretched.

Because the hold-down element 31 has been pressed downwards by manually pivoting the arch 34, the bracket member 27, and thus the stretching head 22, are lifted. On the one hand, the stretching head can now be retracted for carrying out another stretching operation and placed into position again, and on the other hand the entire stretching device 15 can be laterally shifted in order that other sections of the carpet 11 may be stretched.

During this operation, the great width of the tensioning ledge 28 and the hold-down element 31 has a positive effect. Giving the tensioning ledge 28 as great a width as possible reduces a specific shearing force acting on the nail ledge 14 and thus prevents the ledge from being ripped from the floor 12. The hold-down element 31, which is as wide as possible, also presses onto the nail ledge those sections of the carpet 11 which are adjacent the stretching head 22 so that the stretched carpet 11 is prevented from coming off or being ripped off.

In order to effectively stretch the carpet into the corners of a room as well, the tensioning ledge 28 and the hold-down element 31 are laterally shifted on their respective first and second bracket members and arranged so as to be affixed thereon so that a shape of a room can also be taken into account.

The design and arrangement of lever 20 is advantageous in that, during the stretching operation, the lever is moved both towards the wall 16 and towards the floor 12, which leads to a stretching pressure fully acting on the stretching head 22.

In a device of this type, the tensioning ledge and the hold-down element, and thus the stretching head, are positioned in immediate vicinity of a wall. This means that a distance between the stretching head and the wall is so small that the carpet is prevented from forming waves and folds while it is being fitted. Hence, the carpet is placed under maximum tension and fully stretched.

In detail, the invention is designed such that the tensioning ledge and the hold-down element are each respectively mounted on a first and second bracket member, with these two bracket members being arranged on the base unit for pivotal movement about a common fulcrum. On the first bracket member of the tensioning ledge, an arch is pivotally mounted about a pin, with the arch being hingedly connected with the second bracket member of the hold-down element via a link.

When the hold-down element is pressed downwards, the first bracket member is lifted together with the tensioning ledge and at the same time the stretched carpet is pressed into the nails of the nail ledge, which prevents it from moving backwards.

Inasmuch as a guide groove for horizontally guiding the stretching head in a longitudinal direction is also provided in the first bracket member of the tensioning ledge, lifting of the first bracket member for the tensioning ledge also leads to the stretching head being lifted so that its spikes disengage the carpet.

This is advantageous in that when the hold-down element is in its engaging position, the device is shifted along the nail ledge and an adjacent section of the carpet can be fitted.

This process is positively influenced by the fact that the tensioning ledge and the hold-down element are considerably wider than the stretching head. Preferably, they are at least twice as wide as the stretching head.

Thus, the specific shearing force acting on the nail ledge is reduce and the carpet is reliably held. At the same time, those sections of the carpet which have already been laid and are located on both sides of the stretching head are safely prevented from being ripped from the nail ledge.

In order to properly fit carpets of various thicknesses in the corners of a room or near the walls, the tensioning ledge and the hold-down element are adjustable on the first and second bracket members both vertically and horizontally and are arranged so that they can be affixed.

For producing the tensioning force, a lever drive mechanism is provided with the stretching head being hingedly connected to the lever via a coupling rod, the lever being mounted to the base unit for pivotal movement about an axis such that it is movable in a direction of movement of the stretching head when the carpet is being laid.

The invention claimed is:

1. A device for stretching carpets to be laid on a plane floor having nail ledges mounted in a vicinity of walls, said device comprising a stretching head (22) having spikes for engaging a carpet and a lever (20) pivotally arranged on a base unit of said device and being linked to said stretching head for causing said stretching head to move relative to said base unit when said lever is rotated, said device further comprising a tensioning ledge (28) for engaging behind the nail ledge (14) which is pivotally mounted on the base unit (17) for allowing movement of said tensioning ledge in a vertical direction relative to said base unit for positioning said tensioning ledge behind said nail ledge and for removing said tensioning ledge from behind said nail ledge; wherein said device further includes a hold-down element which is pivotally mounted on the base unit for allowing movement of said hold-down element in a vertical direction for engaging carpet positioned at said nail ledge and pressing said carpet toward a top area of said nail ledge.

2. A device according to claim 1 wherein the tensioning ledge and the hold-down element are interconnected such that as the hold-down element (31) is pressed on the carpet at the nail ledge (14) the tensioning ledge (28) is adapted to be lifted in the vertical direction.

3. A device according to claim 2 wherein the tensioning ledge (28) and the hold-down element (31) are attached to their respective first and second bracket members by adjustable attachment means for allowing the positions of the tensioning ledge and the hold-down element to be adjusted relative to the respective first and second bracket members, both vertically and horizontally and for respectively fixedly attaching them to the first and second bracket members.

4. A device according to claim 1 wherein the tensioning ledge (28) and the hold-down element (31) are respectively mounted on first and second bracket members (27 and 30) and in that said first and second bracket members (27 and (30) are attached to the base unit (17) for pivotal movement about at a common fulcrum (19).

5. A device according to claim 4 wherein the first bracket member (27) for the tensioning ledge (28) includes a guide element (36) for the stretching head (22).

6. A device according to claim 4 wherein an arch (34) is pivotally mounted about a pin (33) to the first bracket member (27) of the tensioning ledge (28) and is hingedly connected with the second bracket member (30) of the hold-down element (31) via a link (35).

7. A device according to claim 1 wherein the tensioning ledge (28) and the hold-down element (31) are substantially wider than the stretching head (22).

8. A device according to claim 7, wherein the tensioning ledge (28) and the hold-down element (31) are at least twice as wide as the stretching head (22).

9. A device according to claim 1 wherein the base unit (17) defines a support surface (18), said support surface being arranged in approximately a same plane as a carpet surface on which the stretching head (22) rests when the device is in an operative mode.

10. A device according to claim 1 wherein the stretching head (22) is hingedly connected with the lever (20) via a coupling rod (21), said lever being pivotally mounted at a pin (23) to the base unit (17) such that it is movable in a direction of movement of the stretching head (22) when the carpet (11) is being stretched.

11. A device according to claim 10 wherein the lever (20) rests substantially horizontally between the bracket members (27 and 30) when the stretching head (22) is in its stretched position.

* * * * *